United States Patent [19]

Jaworski et al.

[11] 4,333,657

[45] Jun. 8, 1982

[54] ELECTRONIC DART GAME

[75] Inventors: Eugene Jaworski, Park Ridge; Harry Disko, South Barrington; Jeffrey D. Breslow, Highland Park, all of Ill.

[73] Assignee: Marvin Glass & Associates, Chicago, Ill.

[21] Appl. No.: 119,888

[22] Filed: Feb. 8, 1980

[51] Int. Cl.[3] ..... A63F 9/02; F41J 5/04

[52] U.S. Cl. ..... 273/376; 273/85 G; 273/368

[58] Field of Search ..... 273/374, 375, 376, 415, 273/1 E, 85 G, 121 A, 127 R, 310, 368; 200/61.11

[56] References Cited

U.S. PATENT DOCUMENTS

| | | | |
|---|---|---|---|
| 2,241,670 | 5/1941 | McMaster | 273/310 |
| 2,247,751 | 7/1941 | Eakins | 273/310 |
| 3,170,692 | 2/1965 | Keosiff | 273/415 X |
| 3,972,531 | 8/1976 | Knapp | 273/376 |
| 4,058,316 | 11/1978 | Miller | 273/121 A |
| 4,207,087 | 6/1980 | Morrison et al. | 273/1 E |
| 4,216,968 | 8/1980 | Yeeda | 273/376 |
| 4,266,776 | 5/1981 | Goldfarb | 273/310 |

*Primary Examiner*—Anton O. Oechsle

*Attorney, Agent, or Firm*—Mason, Kolehmainen, Rathburn & Wyss

[57] ABSTRACT

An electronic dart game includes the provision of a housing and a plurality of generally radially positioned target areas. The housing may be self-supporting or may include means for supporting the housing on a vertical surface such as a wall or door. The targets comprise a plurality of generally tapered or pie-shaped segments, each segment being a depressible panel or switch for establishing an electrical contact when depressed. A plurality of projectiles, preferably loosely filled flexible packets, are hurled by the players toward the targets. Because of the proximity to one another and the adjacent nature of the innermost tips of the panels, a plurality of panels, or switches, may be actuated upon being hit by one of the projectiles. Each of the panels includes a light source, such as a light emitting diode, to indicate when the panel has been actuated. A microcomputer and associated circuitry is programmed to provide a plurality of games for a predetermined number of players. The housing may include a catch gutter for the projectiles and a plurality of switches for operating the game as well as a display for indicating a score or other relevant information.

25 Claims, 6 Drawing Figures

ELECTRONIC DART GAME

BACKGROUND OF THE INVENTION

1. Field of the Invention

This invention relates to electronic games and in particular to a microcomputer controlled dart game.

2. Brief Description of the Prior Art

The present miniaturized electronics revolution has been responsible for the appearance of many handheld articles and games such as calculators or games which process stored chess-playing algorithms. Other electronic games are known, such as the electronic keyboard game disclosed in U.S. Pat. No. 4,207,087 filed Sept. 19, 1977 and assigned to the Assignee for the present invention. Also, electronically controlled games simulating the known game of "Battleship" are known wherein a microprocessor is employed to store the secret location of each player's target and to provide an indication when the opposing player's keyboard selection of areas sinks the battleship. In addition, many games have been proposed which attempt to simulate a known type of sporting event, such as the auto race and football games shown in U.S. Pat. No. 4,162,792.

While these games provide a great deal of amusement, the prior art does not disclose any portable electronic game that requires a relatively high degree of skill on the part of the players and a modification of the known game of "Darts".

SUMMARY OF THE INVENTION

Accordingly, it is one object of the present invention to provide an electronic dart game.

It is another object of the present invention to provide a game of the above character which is simple and economical to manufacture and safe for use by children of all ages.

The invention which satisfies the above and other objects may be briefly summarized as an electronic dart game including the provision of a housing and a plurality of generally radially positioned target areas. The housing may be self-supporting or may include means for supporting the housing on a vertical surface such as a wall or door. The targets comprise a plurality of generally tapered or pie-shaped segments, each segment being a depressible panel or switch for establishing an electrical contact when depressed. A plurality of projectiles, preferably loosely filled flexible packets, are hurled by the players toward the targets. Because of the proximity to one another and the adjacent nature of the innermost tips of the panels, a plurality of panels, or switches, may be actuated upon being hit by one of the projectiles. Each of the panels includes a light source, such as a light emitting diode, to indicate when the panel has been actuated. A microcomputer and associated circuitry is programmed to provide a plurality of games for a predetermined number of players. The housing may include a catch gutter for the projectiles and a plurality of switches for operating the game as well as a display for indicating a score or other relevant information.

BRIEF DESCRIPTION OF THE DRAWINGS

FIG. 1 is a front perspective view of a game apparatus made in accordance with the concepts of the present invention;

DESCRIPTION OF THE PREFERRED EMBODIMENT

Figure 5:
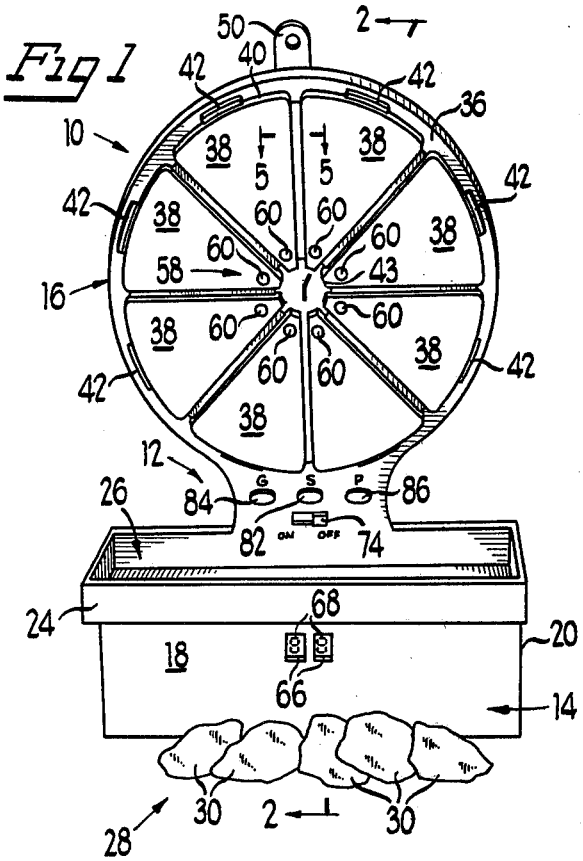
FIG. 5 is a horizontal section taken generally along line 5—5 of FIG. 1.
Figure 2:
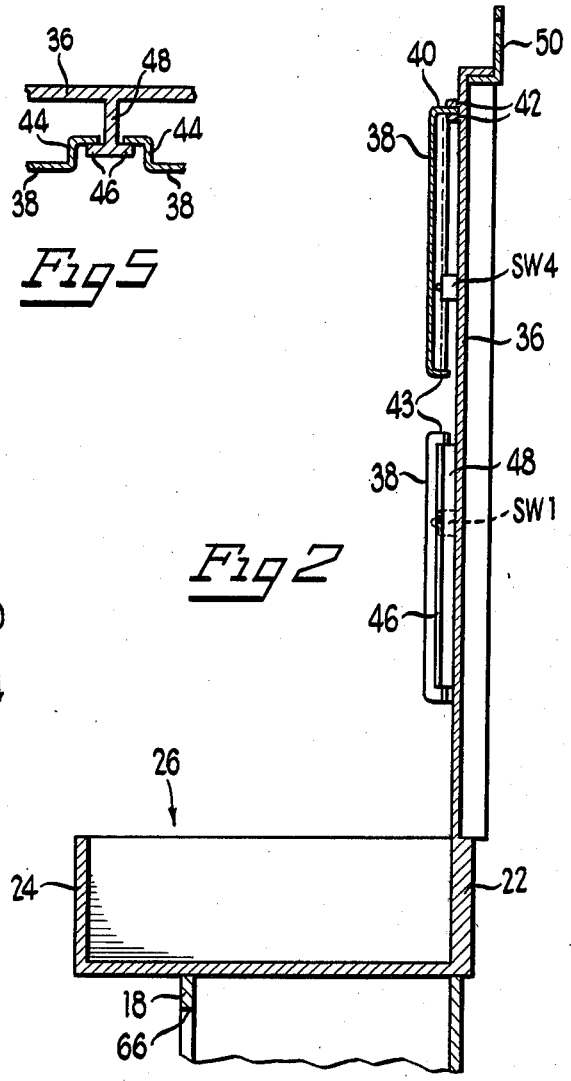
FIG. 2 is a partially fragmented, cross-sectional view taken generally along line 2—2 in FIG. 1.

An electronic dart game appartus made in accordance with the concepts of the present invention is shown in FIG. 1 and generally designated by the reference numeral 10. The game 10 includes a housing, generally designated 12, which includes a base portion 14 and a top generally circular portion 16. In one form of the invention, the game apparatus is self-supporting on a suitable horizontal surface in which case, the base 14 is larger, in depth, than the upper housing portion 16 to support the game. The base includes a front wall 18, a pair of slide walls 20 and a rear wall which defines a lower, generally rectangular housing. An upper peripheral rim or flange 24 defines a projectile receiving gutter 26 generally on the top of the base 14.

In the preferred embodiment, the projectiles, generally designated 28, include one or more generally moldable projectiles 30. More specifically, each projectile 30 includes an outer, generally flexible covering such as cloth, or the like, which defines an inner cavity which is partially filled with particulate material. The projectiles 30 are thus similar to the conventional "beanbag" so that, while the projectiles are weighted and easily directed toward a target, they are safe for use by children of any age, both indoors and out of doors. During the play of the game, the projectiles are launched toward a plurality of target areas, generally designated 34 on the upper housing portion.

The upper housing 16 includes a housing support structure 36 which is mounted by a neck portion 38 to the rear wall 22 of the base 14. The target areas 4 are then defined on the front face of the housing portion 36 so that projectiles which strike one of the target areas 34 will fall into the projectile receiving gutter 26 for reuse. The target areas 34 are defined by a plurality of, in the preferred embodiment, generally pie-shaped panels 38, each of which extends from an arcuate wall 40, generally inwardly from the outer periphery of the housing support 36 through an elongated tapered portion terminating generally at the center of the housing support section 36 at a pointed or blunted end 43. Each of the panels 38 are mounted for forward and rearward movement in a conventional manner such that, when struck by one of the projectiles 30, the panel 38 will move rearwardly.

Figure 4:
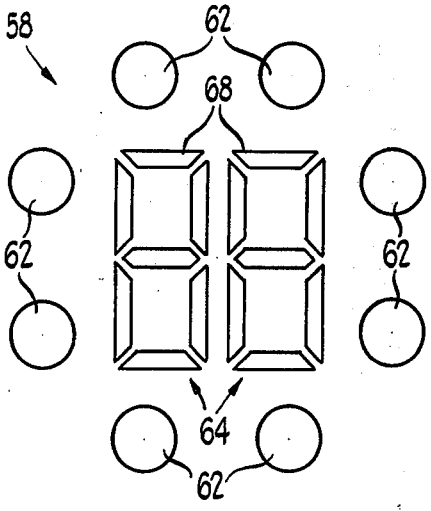
FIG. 4 is an enlarged, partially fragmented, front view of the display in one embodiment of the invention.

Each one of the panels 38 is also biased toward the forward position by a biasing means such as a leaf spring, or the like, which maintains the panel 38 in its forwardmost position. Switch means are mounted behind each one of the panels 38 so that, upon rearward movement of the panel 38 by contact with one of the projectiles, the switch means is closed, indicating that a particular panel 38 has been struck or actuated by one of the "beanbag" projectiles. In the preferred embodiment, there are eight pie-shaped target panels and thus eight switches SW1–SW8, one being associated with each one of the panels 38. The panel switches SW1–SW8 are shown in the schematic drawing of FIG. 4.

In the embodiment of FIG. 1, each panel 38 is mounted by a portion of its rear arcuate flange 40 by a channel defined by two forwardly extending arcuate ribs 42 to the housing support section or back wall 36. The panels 38 are made of a resilient plastic so that the mounting of the flange 40 between the ribs 42 provides the biasing means to maintain or urge the surface of the panel 38 to a plane which is parallel with the wall 36. In addition, referring to FIG. 5, each of the panels 38 includes a generally L-shaped side wall 44 which is encapsulated or fits under the edges 46 of a T-flange 48 mounted on the back wall 36. In this manner, the T-flange 48 prevents the panels 38 from being biased outwardly further than a parallel relationship with the back wall. The switches SW1–SW8 are mounted in a position behind the panels to be actuated whenever a projectile strikes one of the panels. This description is obviously only one of a plurality of methods of movably mounting the panels which may include any number of other mountings.

As described previously, the relatively large base portion 14 may be required or desirous in the selfsupporting game apparatus. However, it is also contemplated that means, such as the eyelet 50 be provided on the support housing portion 36 so that the game apparatus 10 may be supported on a vertical surface such as a wall or door. In this embodiment, the weighted base portion 14 would not be necessary although the projectile receiving gutter 26 may be desirable. In the alternate embodiment as shown in FIG. 3, for example, the game apparatus 10 does not include the large base structure 14 as shown in FIG 1.

Figure 3:
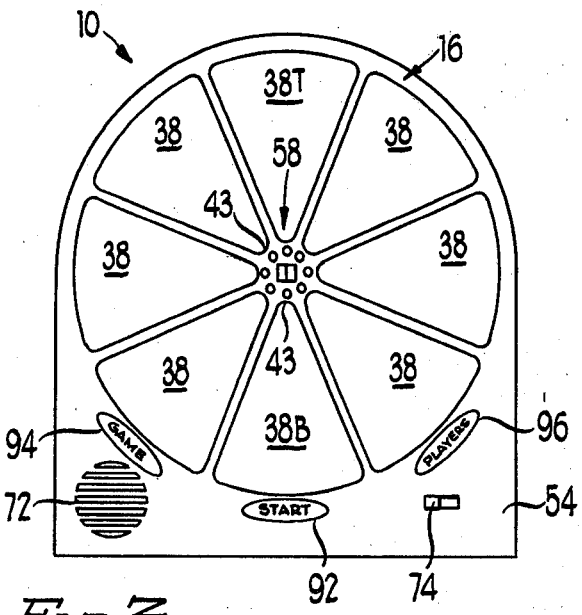
FIG. 3 is a perspective view of an alternate embodiment of the present invention.
Figure 6:
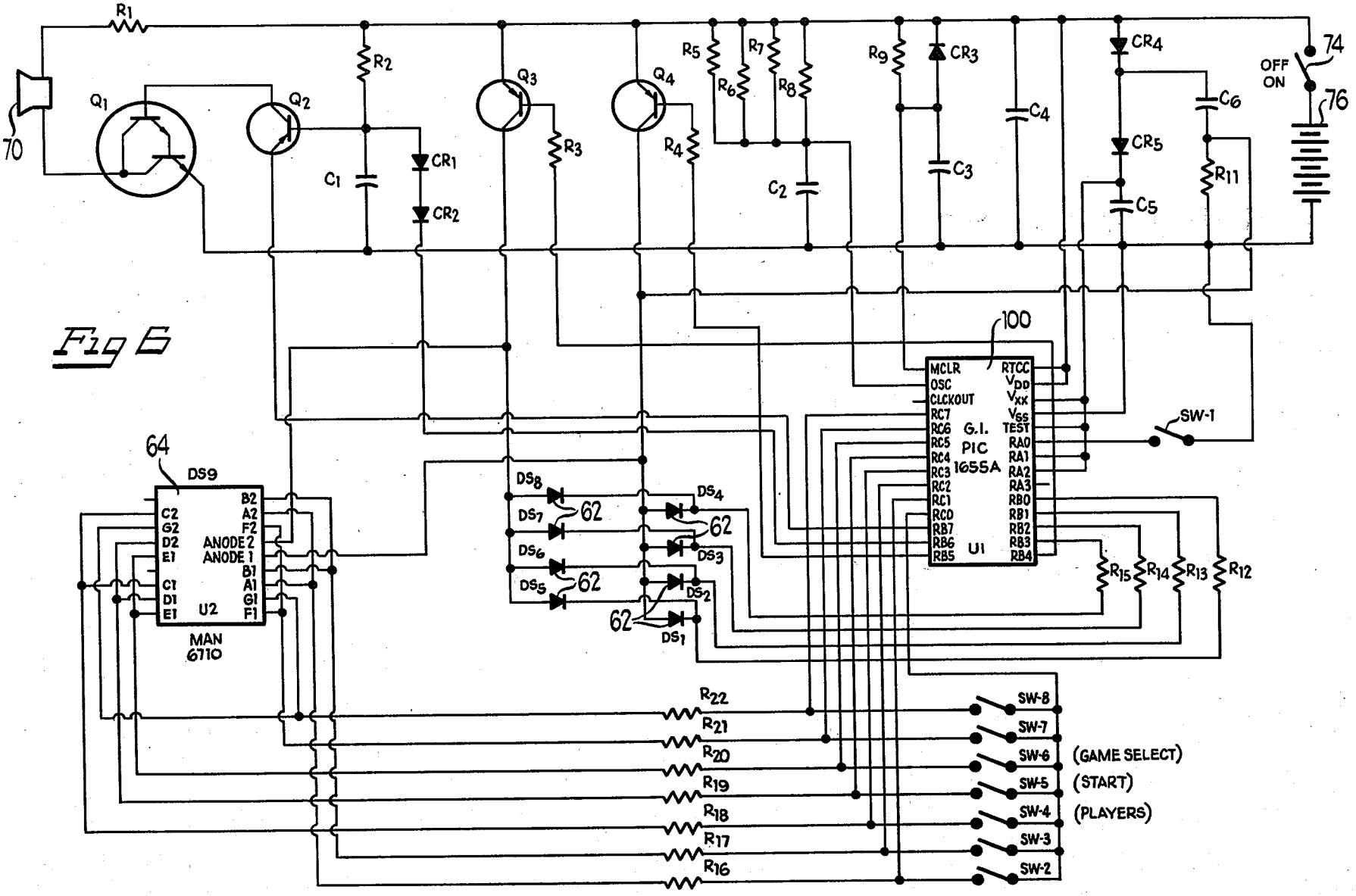
FIG. 6 is an electrical schematic of an electrical circuit incorporated within the game apparatus of FIG. 1 to control the operation of the game in accordance with a predetermined game play.

In addition, the alternate embodiment of the present invention as shown in FIG. 3 contemplates the rotation of the panels 38 through an angle equivalent to half of one of the panels, or in the case of eight panels, 22.5°. Thus, in this embodiment, there is a topmost panel 38T and a bottommost panel 38B. In addition, the base portion 15 is essentially eliminated and replaced by an enlarged throat portion 54. The hanging eyelet 50 may be replaced by similar hooks or apertures in the back wall 22 of the housing.

Both of the embodiments shown in FIGS. 1 and 3 include a display means, generally designated 58 which includes a production of a sensorially perceptible event. The display means 58 of the embodiment shown in FIG. 3 is shown in an enlarged view in FIG. 4 for clarity. In the embodiment shown in FIG. 1, the display means 58 may include a plurality of lights or light emitting diodes 60 mounted directly on the panels 38 which may be lighted to indicate activation or the hitting or missing of an attempted strike. In the alternate embodiment of FIG. 4, the light sources or light emitting diodes comprise a similar number of diodes 62 mounted in the central area with each diode 62 being positioned adjacent the vertex 43 of one of the panels 38. Obviously, within the scope of the present invention, the light sources could be the diodes 62 placed anywhere adjacent to or on the panels 38. As will be described in detail hereinafter, with respect to the play of the various games, the lights or light emitting diodes 60 or 62 are utilized to indicate when a particular panel has been activated or struck by a projectile 30 or for other uses as will be described .

In addition to the visual indicating means 60 and 62, additional indicators in the form of an alphanumeric display means, generally designated 64, is also provided. In the first embodiment, the display means 64 appears through a pair of rectangular apertures 66 in the base portion, while in the embodiment shown in FIG. 3, the display means 64 is mounted right in the center of the target area. The alphanumeric display means comprises two seven-segment displays 68 which is described in further detail hereinafter with respect to the schematic of FIG. 5. In order to add additional interest and playability to the game, the sensorially perceptible events produced by the device also include a plurality of audible signals. The audible signals are produced by a speaker 70 (FIG. 5) mounted on the housing 12, such as behind the speaker grill 72 shown in FIG. 3 or on the back of the housing as in the embodiment contemplated by FIG. 1. The speaker produces various "wind", "razz", "bing-bong" or similar tones as are described hereinafter. Finally, in order to operate the game, certain mechanical input switches are provided to energize the electronic elements of FIG. 5. For example, an off-on switch 74 is mounted on the housing to connect a power supply 76 to the circuit means which is generally designated 80 in FIG. 5. In the preferred embodiment, it is contemplated that the power supply comprises 4 "D" batteries which provide an output between 4.5 and 7 volts DC. In the embodiment of FIG. 1, a central switch 82 is mounted on the throat portion to be depressed at the "start" of the game. To the left of the "start" button, a similar "game" button 84 is provided to select which one of the plurality of games will be played. Lastly, a player's button 86 is mounted to the right of the start button for use in inputting the number of players which will be playing a particular game. In the alternate embodiment shown in FIG. 3, three of the panel switches SW1–SW8 are utilized in a dual capacity to provide the same information as described with respect to the butons 82–86. In particular, a central area 92 toward the bottom of the housing 12, just below the panel **38*b* is embossed with the word "start" to indicate that the panel 38*b* is depressed to start a game. The SW5 switch which is made by depressing the panel 38*b* is utilized in a time-sharing mode as the start switch. Similarly, an embossed area 94 adjacent the arcuate section of the panel 38 to the left of the panel 38*d* is embossed with the word "game" so that the associated switch, SW6, operates as the game selector switch in a similar manner. Likewise, a third area 96 is embossed with the indicia "players" to indicate that the SW4 switch activated by depressing the panel 38 to the right of the bottommost panel 38*b*** is utilized to indicate the number of players to be playing a particular game.

With reference to the foregoing FIGS. 1–4, the circuit means 80 of FIG. 5 is incorporated within the housing 12 and provides a microcomputer capable of playing a plurality of different games with the game apparatus described above. The circuit means 80 is controlled by a microprocessor 100 which, in the preferred embodiment, is a PIC1655A microprocessor manufactured by General Instruments Corporation, 600 West John Street, Hicksville, N.Y. A Darlington transistor Q1 and another transistor Q2 drive the speaker 70 to produce the various tones during the play of the game. Another pair of transistors Q3 and Q4 drive the panel light emitting diodes 62. The alphanumeric display 64 designated DS9 is a dual seven-segment display, MAN6710 manufactured by Monsanto or an equivalent display. The various combinations of resistors, capacitors and diodes to the right of Q4, as selected by the microprocessor 100, produce the various tones described in the following game play. A blueprint of the actual schematic is provided in the appended Appendix A to illustrate the typical component values utilized in the schematic in accordance with one embodiment of the present invention. The schematic in the appendix shows each of the pin connections on the microprocessor 100 as well as the transistor identification numbers. In addition, in the embodiment as shown in FIG. 1, where separate switches are utilized for the start, game select and player functions, the mechanical switch elements would be provided as separate switches connected in parallel with SW5, SW6 and SW4, respectively.

The microprocessor 100 is programmed, as contemplated by the present invention, to play five different games wherein each of the games may be played by one to five players. At the beginning of play, when the on-off switch 74 is moved to the on position, a "beep" sound is produced, the eight light mitting diodes 62 begin alternately blinking and the display 64 shows the numerals 11. The next step is for the players of the game to select which one of the five games they wish to play. To input the game number, i.e., 1, 2, 3, 4 or 5, one of the players depresses the game button 84 or the panel 38 adjacent the game boss 94 a number of times equal to the desired game number. Each depression of the switch SW6 is accompanied by a "beep" tone and the game number appears on the left digit of the display 68. Next, the players must input the number of players that are going to participate in the particular game. The number of players is provided by depressing the button 86 or the panel 38 adjacent the boss 96 a number of times equal to the number of players, i.e., 1, 2, 3, 4 or 5. Again, each entry is accompanied by a "beep" tone and the number of players is displayed on the right digit 68 of the alphanumeric display 64. The game is then ready for play and one of the players depresses the "Start" button 82 or the panel **38*b* adjacent the start boss 92 to begin play. At the beginning of play of any game, the first player's turn is indicated by a display P1 on the alphanumeric display 64** and so on through all of the players, P2, P3, P4, etc.

GAME NO. 1—"PINBALL"

The object of the "Pinball" game is to score the most number of points in one turn. This game starts with all eight panel lights 60 or 62 in the off position with the display showing P1 or the appropriate player's designation as it occurs. Player 1 then begins by pitching the projectiles 30 toward the target provided by the panels 38 in an attempt to cause each panel light to be lit by temporarily closing one of the switches SW1–SW8. A player's turn comprises the throwing of six projectiles giving him six "hits" or fewer if the eight lights 62 are turned on. A "hit" on one of the panels 38 turns on the associated light 60 or light emitting diode 62 and is also accompanied by a "beep" tone.

The specific design of the panels 38 is such that a portion of each panel extends into a central or "prime" target area in the center of the upper housing portion 16. This prime target area is designated as such since, because the projectiles 20 are in the form of "beanbags", one projectile is capable of simultaneously striking and activating more than one of the panels 38. In fact, an accurately launched projectile is capable of actuating all eight of the panels simultaneously. Similarly, any number of additional panels could be actuated if desired. For this reason, the game apparatus 10 maintains many of the conventional game play strategies utilized in a dart game since a "bulls-eye" is the maximum score which can be achieved by an on-center strike. In addition, the present game apparatus provides many novel games and routines as provided by the programming of the microprocessor.

As described above, a "hit" on one of the panels 38 turns the associated light on while providing a "beep" tone. When a projectile hits a panel which has already been lighted by a previous hit in the same player's turn, no additional score will register even though a "hit" will be recorded as one of the player's six attempts to indicate this "loss" of a hit, a "razz" tone will be produced. While any particular frequency audible signal can be used for any one of the tones described herein, according to the preferred embodiment of the present invention, the "razz" tone has been selected as a 180 Hz frequency signal. In the case of a multiple hit, i.e., one or more panels, all of the associated lights 62 will be lighted and an appropriate score awarded. As described below, a bonus score is awarded for a multiple hit. In the case of a multiple hit of an unlighted panel and a previously lighted panel, the unlighted panel hit is counted and the associated score and tones prevail. A player's turn ends with six registered "hits" or sooner if all eight lights 62 have been turned on.

A scoring is calculated as follows:

A. Each panel light which is turned on scores as five points.

B. A bonus score or "double score" is awarded for any multiple hit combinations (e.g., if three panel lights are turned on with one hit, that hit scores 15 plus a bonus of 15 points).

C. A special bonus is awarded for getting all eight lights on with four hits or less, as follows: all eight lights on in one hit receives a special bonus award of twenty points; all eight lights on with two hits scores a special bonus of fifteen; all eight lights on with three hits scores a special bonus of ten; and all eight lights on with four hits scores a special bonus of five points. The points scored are cumulative so that the five points awarded per panel are added to the bonus for multiple hits and then added to the special bonus for lighting all eight lights with four hits or less. A number of examples of the scoring are calculated below. After the calculations in the chart showing the possible combinations of four hits, the various combinations increase dramatically and, therefore, have not all been listed for the possible combinations for five and six hits. In addition, for those hits shown, any permutation of the combination shown is also possible. The calculations are shown for the points awarded for the particular hits, any bonus points and any special bonus points which are also known as super bonus points to produce the total score.

Examples of scoring in "Pinball" Game

| HITS | LIGHTS ON COMBINATIONS | POINTS | BONUS | SUPER BONUS | TOTAL SCORE |
|---|---|---|---|---|---|
| 1 | 8 | 8 × 5 = 40 | 40 | 20 | 100 |
| 2 | 7 + 1 | (7 × 5) + (1 × 5) = 40 | 35 + 0 | 15 | 90 |
| | 6 + 2 | (6 × 5) + (2 × 5) = 40 | 30 + 10 | 15 | 95 |
| | 5 + 3 | (5 × 5) + (3 × 5) = 40 | 25 + 15 | 15 | 95 |
| | 4 + 4 | (4 × 5) + (4 × 5) = 40 | 20 + 20 | 15 | 95 |
| 3 | 6 + 1 + 1 | (6 × 5) + 5 + 5 = 40 | 30 + 0 + 0 | 10 | 80 |
| | 5 + 2 + 1 | (5 × 5) + (2 × 5) = 40 | 25 + 10 + 0 | 10 | 85 |
| | 3 + 3 + 2 | (3 × 5) + (3 × 5) + (2 × 5) = 40 | 15 + 15 + 10 | 10 | 90 |
| | 4 + 2 + 2 | (4 × 5) + (2 × 5) + (2 × 5) = 40 | 20 + 10 + 10 | 10 | 90 |
| 4 | 5 + 1 + 1 + 1 | (5 × 5) + 5 + 5 + 5 = 40 | 25 | 5 | 70 |
| | 4 + 2 + 1 + 1 | (4 × 5) + (2 × 5) + 5 + 5 = 40 | 20 + 10 | 5 | 75 |
| | 3 + 2 + 2 + 1 | (3 × 5) + 2 × (2 × 5) + 5 = 40 | 15 + 10 + 10 | 5 | 80 |
| | 2 + 2 + 2 + 2 | 4 × (2 × 5) = 40 | 40 | 5 | 85 |
| 5 | 4 + 1 + (3 × 0) | (4 × 5) + 5 = 25 | 20 | 0 | 45 |
| A | 1 + 1 + (3 × 0) | 5 + 5 = 10 | 0 | 0 | 10 |
| N | | | | | |
| D | | | | | |
| 6 | 1(3) + 1 + 3(0) | 2(3 × 5) + 5 = 35 | 30 | 0 | 65 |
| | 6(1) | 6 × 5 = 30 | 0 | 0 | 30 |
| | 1 + 1 + 1 + 3(0) | 3 × 5 = 15 | 0 | 0 | 15 |
| | 6(0) | 0 | 0 | 0 | 0 |

Note that because multiple hits qualify for the double bonus and single hits do not, the score for lighting all eight lights with two hits is higher for the multiple hits 6+2, 5+3, or 4+4, and it is for the combination 7+1. The scores are 95 and 90, respectively. This same advantage is awarded to the multiple hits throughout so that in four hits of two each, the score is higher than any other combination of four hits since any other combination requires at least one hit of only one panel. If any score exceeds "99", the limit of the display 64, score is continued to "00" for 100 and restart at 1. In Game No. 1, as described above, 100 points is the maximum score that can be achieved.

During each of the scoring events described above, an audible signal is produced according to the following example. For lighting all eight panels with one hit:

A. The basic score of 40 points is displayed in the alphanumeric display 64 and this display is accompanied by a "bong" sound such as the conventional ringing sound associated with a pinball game. This display remains on for a period of one second and then turned off during a delay of three seconds before the display of the bonus score.

B. The bonus score doubles the basic score to 80 points which is accomplished in the display in five point steps from 45 to 80. Each display change is accompanied by the same "bong" pinball sound. After the 80 point display is presented for one second, the display is blank for three seconds for adding the special bonus or super bonus which in this case is 20 additional points. Again, the display is incremented five points at a time while all eight light emitting diodes are lighted and accompanied by a five note tune such as a sequence of tones of 200, 250, 333, 500, 1000 Hz signals played rapidly in ascending order bringing the total score to 100 which appears as 00 on the display.

Similar sound sequences and lighting sequences will apply to any other combination of hits but will be shorter than the above described combination since any score must be less than the maximum 100. After the above cumulative scoring and sounding sequence, a player's turn is over and his total score will be flashed two times wherein each display or flash will be accompanied by a "bing-bong" sound indicating the end of his turn. All panel lamps are then reset to the off position and P2 or whatever subsequent player's designation is up will appear on the display.

After all the players participating in the game have finished their turn, the game is over and a winner is determined. The winning sequence next described occurs at the end of each of the games to be described.

When any game is won, the winning player's number, such as P2, flashes followed by a flashing display of his score if applicable, the production of a wind sound such as a plurality of ringing sounds or a futuristic space sound such as "whoop whoop whoop" and the flashing of all eight panel lights 60 or 62. In the case of a tie score, the same sequence is played for all tied players and their score. At the end of this sequence, the display resets to show the game number previously selected and the number of players for the previous round. A new round of play of the same game is initiated by depressing the start button 82 or start panel **38*b***. The same game and same number of players will repeat unless changed by using the games' panel or player's panel. The on-off switch may be utilized at any time to reset the entire program.

GAME NO. 2—"ALL OR NOTHING"

This is a game playable by any number of players in which the object of the game is to either turn all of the panel lights off or on. When a projectile hits one of the targets to actuate the associated switch, the condition of the light emitting diode 62 switches so that if it is off, it turns on or if it is on, it turns off. The game starts with four alternate panel lights on and four alternate panel lights off as one traverses the circle of lights. At the beginning of play, the display 64 shows player number P1.

In this game, a player's turn consists of one throw which is recorded as a "hit". Each hit is accompanied by the previously described "beep" sound. As stated above, when hit, a lighted panel light or associated light emitting diode 62 goes off and a dark panel is lighted. In the case of a multiple hit, all hit panels reverse their condition so that if one was off and one was on the resultant is that the first in now on and the second is now off. After one hit, the display increment show the next player's number, i.e., P2. The second player then attempts to move toward the goal or object of the game, to bring all of the panels or lights 62 to the same condition. Thus, if the first player succeeded in lighting a fifth panel, the second player would attempt to light a sixth panel, the third player would attempt to light a seventh panel, and the last or fourth player would then attempt to light the eighth or last panel. The game ends when all the lights 62 are either on or off, hence, the name of the game "All Or Nothing". The winner is determined as that player who made the last hit to end the game. The game then proceeds through the sequence described above with respect to a win. However, obviously in this game, the score of a particular player is not applicable and is not flashed. Similarly, a tie is obviously not possible in this game.

Strategy as well as accurate launching of the projectiles 30 plays an important part in Game No. 2. For example, in the straightforward example described above, the third player should obviously attempt to make it more difficult or possibly impossible for the fourth player to win so easily. Therefore, instead of lighting the seventh panel, the third player might choose to deactivate or turn off one of the light emitting diodes 62 associated with one of the panels on the opposite side of the target areas. This game then can be a very long game until one player either fails in his strategy to prevent the next player from winning or fails in accurately launching his projectile 20 in order to effect his strategy. Of course, due to the nature of the projectiles 20 in that they are loosely filled sacs of particular material, a "lucky" hit could be achieved at any time to win the game. For example, if, going clockwise, panels 1, 3, 4 and 7 are lit at the beginning of the game, the first player of the game can win by successfully actuating or depressing the panels 2, 4, 6 and 8. Obviously, this occurrence will be very rare indeed.

GAME NO. 3—"MEMORY"

The object of this game is to achieve the highest score based on a memory of which of the panels have the highest value assigned to them at random. The eight panels are randomly assigned different point values for each round of play, i.e., for each player of the game. The point values are increments of five as, for example, 0, 5, 10, 15, 20, 25, 30 and 35. The game starts with the light emitting diode 62 lighting adjacent the top panel 38*t* or any other panel as might be chosen. Simultaneously, the alphanumeric display 68 displays the particular value assigned at random to this top panel. The light remains on for one second while displaying the value and then shifts to the next clockwise panel and displaying that panel's value on the alphanumeric display 68. The value for each panel is thus displayed, the "bong" tone is sounded to accompany all of the panel lights except for the one assigned a "0" value which is accompanied by the previously described "razz" tone.

After the sequencing to identify the point values of all of the panels, the display shows "P1" to start the first player's turn. The first player has twenty seconds in which to attempt to accumulate the highest score. Therefore, he may use as many launchings of the projectiles 20 as required. The "bong" sound is produced each time a panel is properly hit and the cumulative score is displayed with each recorded hit. However, each time a panel light indicating a hit is turned on, that panel remains lighted so that the panel may score only once during a player's turn. Thus, the player will attempt to hit the panels in decreasing order of their point value, if he can remember them properly. Accuracy of launching generally toward the outer or arcuate edge of the panel is important, since, for a multiple panel hit, all hit panel lights will remain lighted but the one hit is awarded the point value for only the lowest point value panel hit and thus eliminates the ability to collect the points which the other panels were worth. If the "0" panel is hit, the player loses all points previously scored in his turn and is also followed by the "razz" sound.

There is a fifteen second delay between each player's turn so that when the first player's turn is over, his score will flash two times accompanied by the "bing bong" tone. A ten second countdown then starts to initiate the second player's turn. The display shows the countdown 10-9-8-etc., with P2 being displayed at the 0 count to start the twenty second period for the second player. In the preferred embodiment described, the second player's turn as well as the remaining players in the game utilize the same point values as defined in the initial randomly assigned numbering system. Alternatively, each of the successive players could receive different point values for the panels thus preventing the last player from having an unfair advantage.

During the countdown, each number of the countdown is accompanied by a tone or sound which starts out at approximately 400 Hz for the count of 10 and increases in frequency 400 Hz for each count with a 4k Hz tone being sounded at the count of 1.

After all the players have had one turn, a winner is determined and indicated as described above with respect to Game No. 1.

GAME NO. 4—CHASING LIGHTS

Game No. 4 provides a moving target which is sometimes indicated by the associated light 60 or light emitting diode 62 and at other times during the game moves at a constant rate but one in which the panels are not indicated by the lights. The game starts with a ten second countdown on a display ending with P1 at 0. Each number on the display as it is shown is accompanied by the "beep" sound of increasing frequency as described above with respect to Game No. 3. Then the light emitting diode 62 for one of the panels 38 is randomly lighted and remains on for approximately one second. The lighted light emitting diode and the associated "active" panel moves clockwise to the adjacent panel. The lighted panel is the only panel or more appropriately the "active" panel is the only panel which will provide a score if "hit" during the period in which the panel is active. The position of the active panel rotates clockwise around the target area at approximately one rotation for every ten seconds. The player's turn is timed and lasts approximately forty seconds. During this forty second play period, the first twenty seconds occurs during approximately the initial two revolutions of the "active" panel while the panel is being indicated by the associated moving light. During the next ten seconds, however, the active panel continues to move at a constant rate but the associated light emitting diodes 62 are not lit and do not indicate the position of the active panel. Thus, the player must attempt to guess at the correct active panel. Since he has had twenty seconds of constant rate movement, as his skill increases, he will be able to accurately judge which of the panels is active while the lights remain off. During the final ten seconds of play, or final revolution of the active panel, the light indications resume.

In order to score, the player must hit the lighted panel during the one second period in which the light is on or, hit the unlighted active panel during the "active time period" for that panel. The time period is actually slightly longer than one second since each revolution of eight panels takes approximately ten seconds. The player may throw as many projectiles as possible in the forty second time period and he will score five points for each active panel hit when the associated light is lit and ten points for each active panel hit when the lighting assistance is not provided. A cumulative score is displayed with each scoring hit accompanied by a "beep" sound. The "razz" tone is provided when a non-active panel is hit. The score remains on the display until changed by the next hit or at the end of a player's turn. The first player's turn is indicated after the forty second period when his score is flashed on the display 64 two times accompanied by a bing bong sound. There is a fifteen second delay between each players turn and a ten second countdown starts prior to the second player's turn as described above. Each number of the countdown is accompanied by a "beep" sound of increasing frequency as described above. The starting point for the subsequent players may or may not be the same as the starting point for the first player. At the end of the game, the win sequence and associated score are displayed as described above with respect to Game No. 1.

GAME NO. 5—"TIME TRIALS"

The object of this game is to score the most points using only six of the projectiles. During this game the panels are assigned different point values in inverse proportion to the length of time the panel remains lighted or the associated light emitting diode 62 remains on. The sequence of panel lighting is always the same and occurs as follows. The first panel ights for two seconds and is worth forty points, the second panel lights for approximately two-and-a half seconds and is worth thirty-five points, the third panel lights for approximately three-and-a-quarter seconds and is worth thirty points, the fourth panel lights for four seconds and is worth approximately twenty-five points, the fifth panel lights for approximately four-and three-quarters seconds and is worth twenty points, the sixth panel lights for approximately five-and-one half seconds and is worth fifteen points, the seventh panel lights for approximately six-and-one quarter seconds and is worth ten points, the eighth panel lights for approximately seven seconds and is worth five points. While the sequence of panel lighting remains the same, the point values for each of the panels changes randomly for each new game.

The game starts with a ten second countdown as described above followed by the light being turned on for the first panel. To score, a player must hit the panel when the light is on. In this case, the panel will score all hits made while the light is on and the panel is active. Therefore, a quick flurry of accurate hits by a player during the beginning part of a game will achieve a large point score because the initial panels are accorded a higher value. However, one of only six projectiles will be lost if the active panel becomes deactivated before it is hit.

The cumulative score will be displayed on each hit wherein each hit is accompanied by the "bong" tone. There is a fifteen second delay between each player's turn and when the first player's turn is over, his score will flash two times, each display being accompanied by a "bing bong" tone. The ten second countdown then starts for the second player P2 as described with respect to Game No. 3. In the preferred embodiment, the point designation for each panel remains the same during an entire game, however, it would be within the scope of the art to randomly reassign the panel point values after each player's turn within a particular game to again avoid giving any one player a particular advantage by having more time to remember the high point scoring panels.

Again, at the end of all of the player's turns, a winning player is determined and identified in the manner as described with respect to Game No. 1.

In addition to the above descriptions, for each of the last three games, after a score of 100 or more is achieved, a five note tune is produced as with respect to the awarding of special bonus or super bonus points as described above in Game No. 1.

The microprocessor 100 is programmed according to conventional programming techniques in accordance with the manufacturer's specification. In the preferred embodiment, the programming encompasses those five games as described hereinabove. The lengthy descriptions of the game play as well as the extent of the details given would permit any programmer to provide the necessary program. However, it is contemplated that, within the spirit and scope of the present invention, many changes and/or modifications could be made to both the physical structure, electrical schematic and game play. Therefore, the foregoing detailed description has been given for clearness of understanding only and no unnecessary limitations should be understood therefrom as many modifications would be obvious to those skilled in the art.

What is claimed is:

1. A microcomputer controlled target game, comprising;

a housing;

a plurality of player actuable target elements mounted on said housing, said target elements being arranged in a generally radial array;

at least one game object;

microcomputer control means for detecting the actuation of a target element by a game object;

means for producing a sensorially perceptible event in response to the detection by said control means of the actuation of a target element;

microcomputer means for detecting the simultaneous actuation of more than one element;

means for automatically accruing a game point value for the simultaneous actuation of more than one target element; and microcomputer means for automatically accumulating the accrued point values of the target elements actuated by a game object.

2. The game of claim 1 wherein said target elements are generally pie-shaped and are arranged in side-by-side alignment.

3. The game of claim 1 wherein said object is a particulate filled flexible container, sized for launching by hand at said target elements.

4. The game of claim 1 including microcomputer means for accumulating the number of elements actuated simultaneously and means for determining the amount of a bonus point assignment in accordance with the number of elements simultaneously actuated.

5. The game of claim 1 including selectively actuable means for switching the state of said target elements between a first and second state in response to each actuation of the target element and means for visually indicating the state of said target elements.

6. The game of claim 1 including selectively actuable means for randomly assigning distinctive point values to a plurality of said elements and means for indicating the randomly assigned value and the element to which said value is assigned.

7. The game of claim 1 including microcomputer means for assigning a point value to at least two of said target elements to be added to said accrued point value in response to actuation of only one of said elements.

8. The game of claim 7 wherein all of said elements have the same point value.

9. The game of claim 1 including means for displaying the accrued point value after each actuation of a target element.

10. A microcomputer controlled target game, comprising:

a housing;

a plurality of player actuable target elements arranged on said housing;

microcomputer control means for detecting the actuation of said target elements;

means for providing a sensorially perceptible event in response to the actuation of an element;

microcomputer means for randomly assigning a distinctive point value to a plurality of said elements; and means for indicating the randomly assigned point value and the element to which said value is assigned.

11. The game of claim 10 wherein said indication of said assigned point value is of short duration such that a player must memorize the assigned point value in order to actuate the most desirable elements.

12. The game of claim 11 including means for deactuating a target element after its initial actuation such that a repeated actuation is not detected.

13. The game of claim 11 including means for assigning the point value of the element which is the lowest of those actuated when multiple elements are simultaneously actuated.

14. The game of claim 10 including means for indicating the duration of said point value assignment.

15. The game device of claim 14 wherein said point value assignment is sequentially varied from one element to the next adjacent element in a timed sequence.

16. The game device of claim 15 including means for automatically discontinuing said indication of the point value assignment after a period of time.

17. The game of claim 15 wherein said point value indication includes means for illuminating only one of said elements at a time, thereby indicating that at that time only one of said elements has a point value, said illuminating means including means for sequentially illuminating said elements.

18. The game device of claim 10 wherein the time duration of said event is indicative of the value assigned to the associated element.

19. The game of claim 10 wherein said target elements are arranged in a radial array and are generally pie-shaped.

20. The game of claim 15 wherein said point value assignment is varied at a constant rate.

21. A microcomputer controlled game, comprising:

a housing;

a plurality of player actuable elements arranged on said housing;

microcomputer control means for detecting the actuation of said elements;

means for providing a sensorially perceptible event in response to the actuation of an element;

means for monitoring an element to determine if it is actuated within a predetermined time period, including means for successively monitoring at a constant rate one element after another;

means for indicating when an element is being monitored; and means for discontinuing said indication when the element is being monitored after a period of time such that a player must mentally time the monitoring sequence in order to actuate the proper element in rhythm with the sequence of said monitoring means without the benefit of the indication that the element is being monitored.

22. The game of claim 21 wherein said elements are target elements, said game including a projectile for actuating said elements.

23. The game of claim 22 wherein said elements are pie-shaped and are arranged in a side-by-side radial array.

24. The game of claim 23 wherein said monitoring means proceeds from one element to its adjacent element in succession.

25. The game of claim 21 including means for assigning a point value to each element and means for accruing the point values of the elements actuated within the predetermined time period.

* * * * *